US008111158B2

(12) United States Patent
Aizawa

(10) Patent No.: US 8,111,158 B2
(45) Date of Patent: Feb. 7, 2012

(54) INTRUSION DETECTION SYSTEM

(75) Inventor: Shuji Aizawa, Chiyoda-Ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 446 days.

(21) Appl. No.: 12/333,612

(22) Filed: Dec. 12, 2008

(65) Prior Publication Data

US 2009/0153147 A1 Jun. 18, 2009

(30) Foreign Application Priority Data

Dec. 17, 2007 (JP) ..... 2007-324777

(51) Int. Cl.
*G08B 13/18* (2006.01)

(52) U.S. Cl. ..... 340/552; 340/561; 340/565; 340/541

(58) Field of Classification Search ..... 340/552, 340/545.3, 567, 561, 540, 541
See application file for complete search history.

(56) References Cited

U.S. PATENT DOCUMENTS

| | | | | |
|---|---|---|---|---|
| 5,914,655 | A * | 6/1999 | Clifton et al. | 340/506 |
| 6,252,507 | B1 * | 6/2001 | Gagnon | 340/552 |
| 6,271,754 | B1 * | 8/2001 | Durtler | 340/552 |
| 6,288,640 | B1 * | 9/2001 | Gagnon | 340/539.17 |
| 6,577,236 | B2 * | 6/2003 | Harman | 340/552 |
| 7,576,648 | B2 * | 8/2009 | Harman | 340/552 |
| 2003/0210734 | A1 | 11/2003 | Kaku | |
| 2007/0152817 | A1 | 7/2007 | Nishigaki et al. | |
| 2007/0152818 | A1 | 7/2007 | Sato | |
| 2008/0252452 | A1 | 10/2008 | Aizawa | |

FOREIGN PATENT DOCUMENTS

| | | | |
|---|---|---|---|
| JP | 63-291195 | A | 11/1988 |
| JP | 2003-324360 | A | 11/2003 |
| JP | 2003-324368 | A | 11/2003 |
| JP | 2007-179401 | A | 7/2007 |
| JP | 2007-179402 | A | 7/2007 |
| JP | 2007-189521 | A | 7/2007 |

* cited by examiner

*Primary Examiner* — Toan N Pham
(74) *Attorney, Agent, or Firm* — Buchanan Ingersoll & Rooney PC

(57) ABSTRACT

An intrusion detection system includes an intrusion detection device, and a pair of leaky transmission paths including a leaky transmission path of a sending side which is connected to the intrusion detection device and outputs a leaky electric wave on the basis of an output from the intrusion detection device and a leaky transmission path of a receiving side which receives the leaky electric wave output from the leaky transmission path of the sending side, and the intrusion detection device detects that the leaky electric wave received in the leaky transmission path of the receiving side varies to detect the presence or absence of intrusion and an intrusion point.

16 Claims, 14 Drawing Sheets

DETECTION TABLE 521

| X1 | Y1 | X2 | Y2 | X3 |
|---|---|---|---|---|
| DETECTION | NON-DETECTION | DETECTION | NON-DETECTION | DETECTION |

INTRUSION DETECTION SYSTEM

BACKGROUND OF THE INVENTION

1. Field of the Invention

The present invention relates to an intrusion detection system that has a pair of leaky transmission paths including a leaky transmission path of a sending side which is connected to an intrusion detection device and outputs a leaky electric wave on the basis of an output from the intrusion detection device and a leaky transmission path of a receiving side which receives the leaky electric wave output from the leaky transmission path of the sending side, and that performs intrusion detection by the intrusion detection device which detects variation of the leaky electric wave received in the leaky transmission path of the receiving side.

2. Description of the Related Art

An intrusion detection system that has a pair of leaky transmission paths including a leaky transmission path of a sending side which is connected to an intrusion detection device and outputs a leaky electric wave on the basis of an output from the intrusion detection device and a leaky transmission path of a receiving side which receives the leaky electric wave output from the leaky transmission path of the sending side, and that performs intrusion detection by the intrusion detection device which detects variation of the leaky electric wave received in the leaky transmission path of the receiving side is a relatively recent technology, as shown in, e.g., US-2007-0152817-A1 (corresponding to JP-A-2007-179402), US-2007-0152818-A1 (corresponding to JP-A-2007-179401), JP-A-2007-189521, and U.S. patent application Ser. No. 11/907,053 (not laid open into public as of Mar. 17, 2008). Accordingly, the practical use of the technology also began relatively recently. Since the system is used to detect intrusion of a person entering a factory or a runway of an airport, for example, and is not installed around electric equipment causing noise, measures for noise caused by other electric equipment are not necessary, in general. Accordingly, the measures for noise are not made.

As described above, the intrusion detection system that has the pair of leaky transmission paths including the leaky transmission path of the sending side which is connected to the intrusion detection device and outputs the leaky electric wave on the basis of the output from the intrusion detection device and the leaky transmission path of the receiving side which receives the leaky electric wave output from the leaky transmission path of the sending side, and that performs the intrusion detection by the intrusion detection device which detects the variation of the leaky electric wave received in the leaky transmission path of the receiving side is used to detect the intrusion of a person entering a factory or a runway of an airport, for example, and is not installed around the electric equipment causing noise, and thus the measures for noise caused by other electric equipment are not necessary, in general. Accordingly, the measures for noise are not made. However, when the detection of the intrusion of a person is a target, it is necessary to assume that an intruder having highly-specialized experience intrudes. In such case, when the intruder intrudes while emitting a disturbing wave similar to a leaky electric wave received in the leaky transmission path of the receiving side, the intrusion detection device which detects the variation of the leaky electric wave received in the leaky transmission path of the receiving side may malfunction.

SUMMARY OF THE INVENTION

The invention is contrived to solve the above-described problem, and an object of the invention is to prevent the intrusion detection device from malfunctioning even if the intrusion detection device is affected by the disturbing wave.

According to an aspect of the invention, an intrusion detection system includes: an intrusion detection device; and a pair of leaky transmission paths including a leaky transmission path of a sending side, connected to the intrusion detection device, for emitting a leaky electric wave supplied from the intrusion detection device and a leaky transmission path of a receiving side for receiving the leaky electric wave emitted from the leaky transmission path of the sending side. The intrusion detection device detects an intrusion and its point from a variation of the leaky electric wave received in the leaky transmission path of the receiving side. An anti-disturbing wave function unit for removing or reducing a disturbing wave intruding into the leaky transmission path of the receiving side is provided, in the intrusion detection device, so that the intrusion detection device determines the intrusion and its point using the leaky electric wave processed by the anti-disturbing wave function unit. Accordingly, it is possible to prevent the intrusion detection device from malfunctioning even if the intrusion detection device is affected by the disturbing wave.

The foregoing and other object, features, aspects, and advantages of the present invention will become more apparent from the following detailed description of the present invention when taken in conjunction with the accompanying drawings.

BRIEF DESCRIPTION OF THE DRAWINGS

The same reference numerals or the same reference symbols in each of FIGS. 1 to 11 represent the same or substantially the same part.

DESCRIPTION OF THE PREFERRED EMBODIMENTS

First Embodiment

Figure 1:
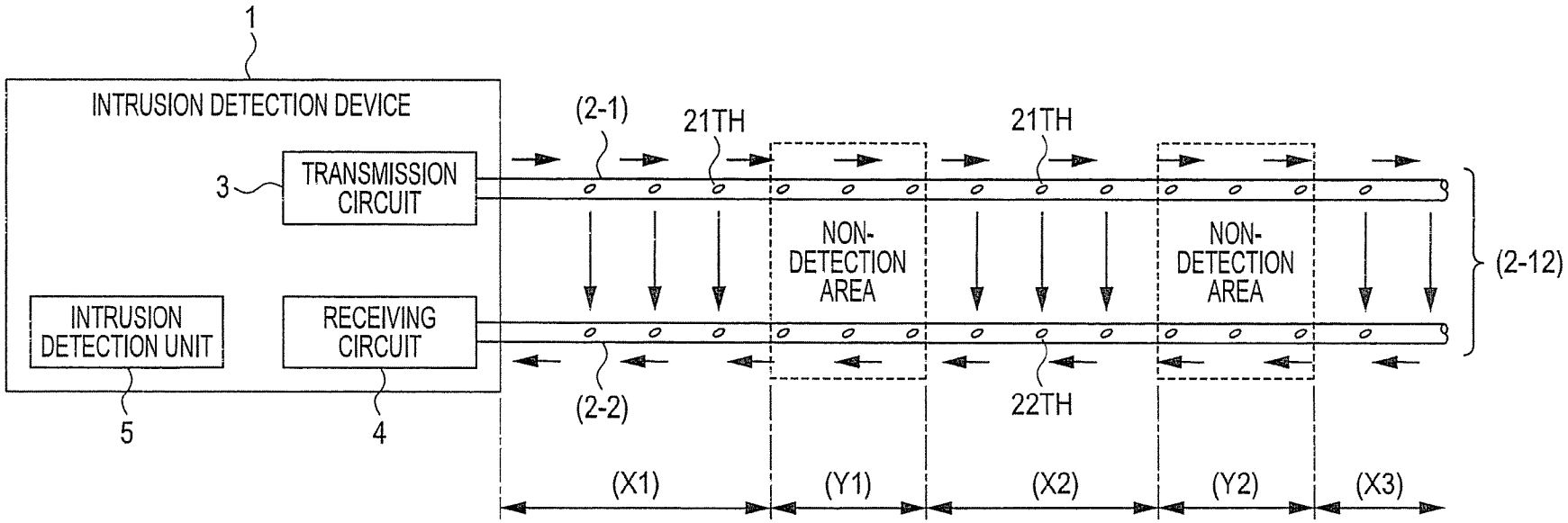
FIG. 1 is a view illustrating an example of a system configuration of an intrusion detection system according to a first embodiment of the invention.
Figure 2:
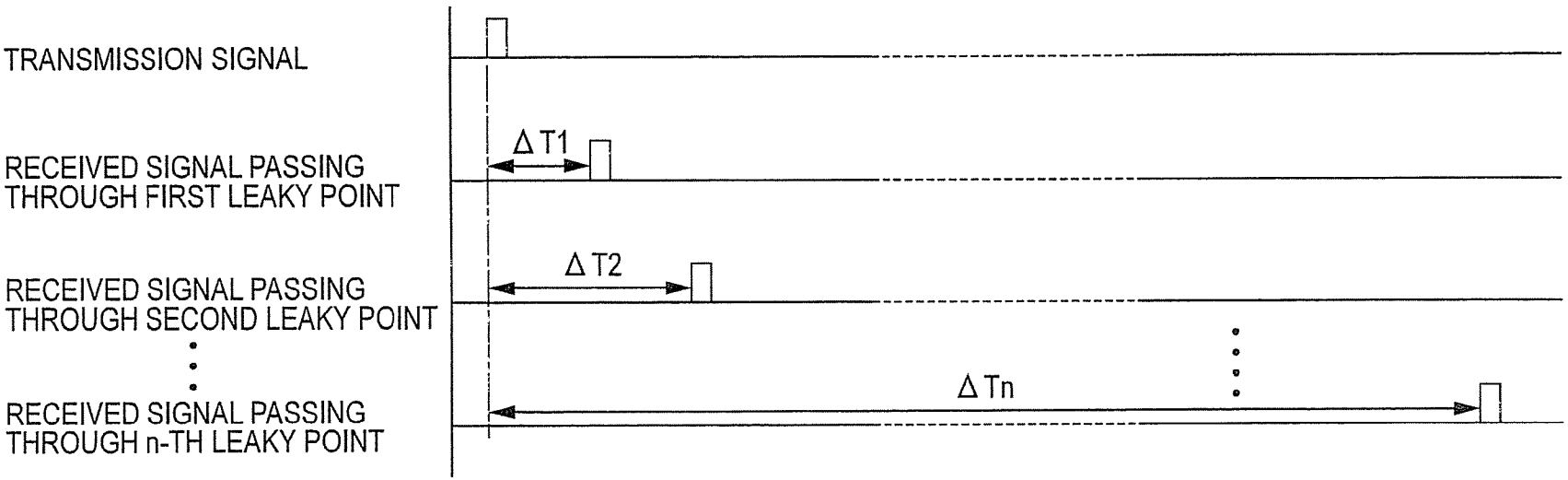
FIG. 2 is a view illustrating an example of the concept of detection for an intrusion location according to the first embodiment of the invention.
Figure 3:
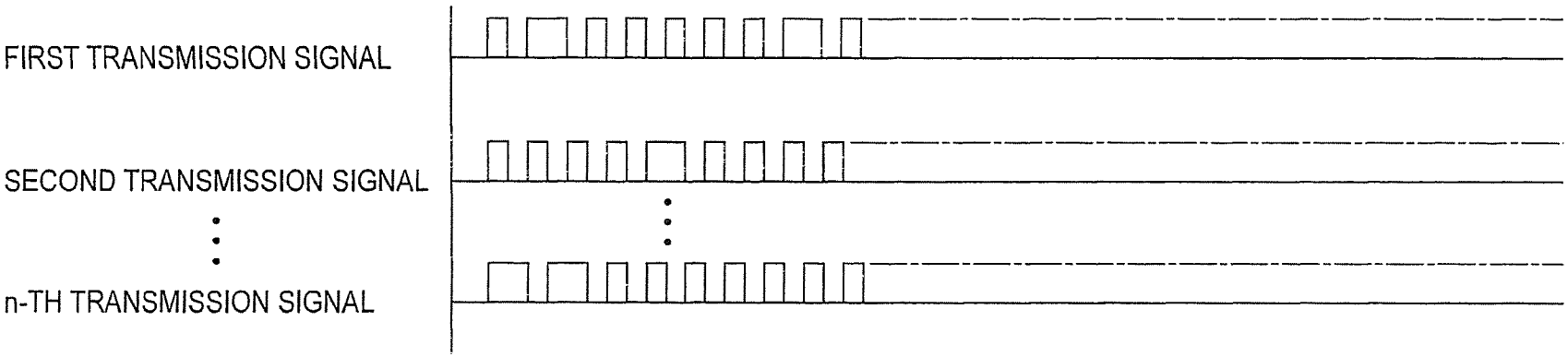
FIG. 3 is a view illustrating a specific example of a transmission signal according to the first embodiment of the invention.
Figure 4:
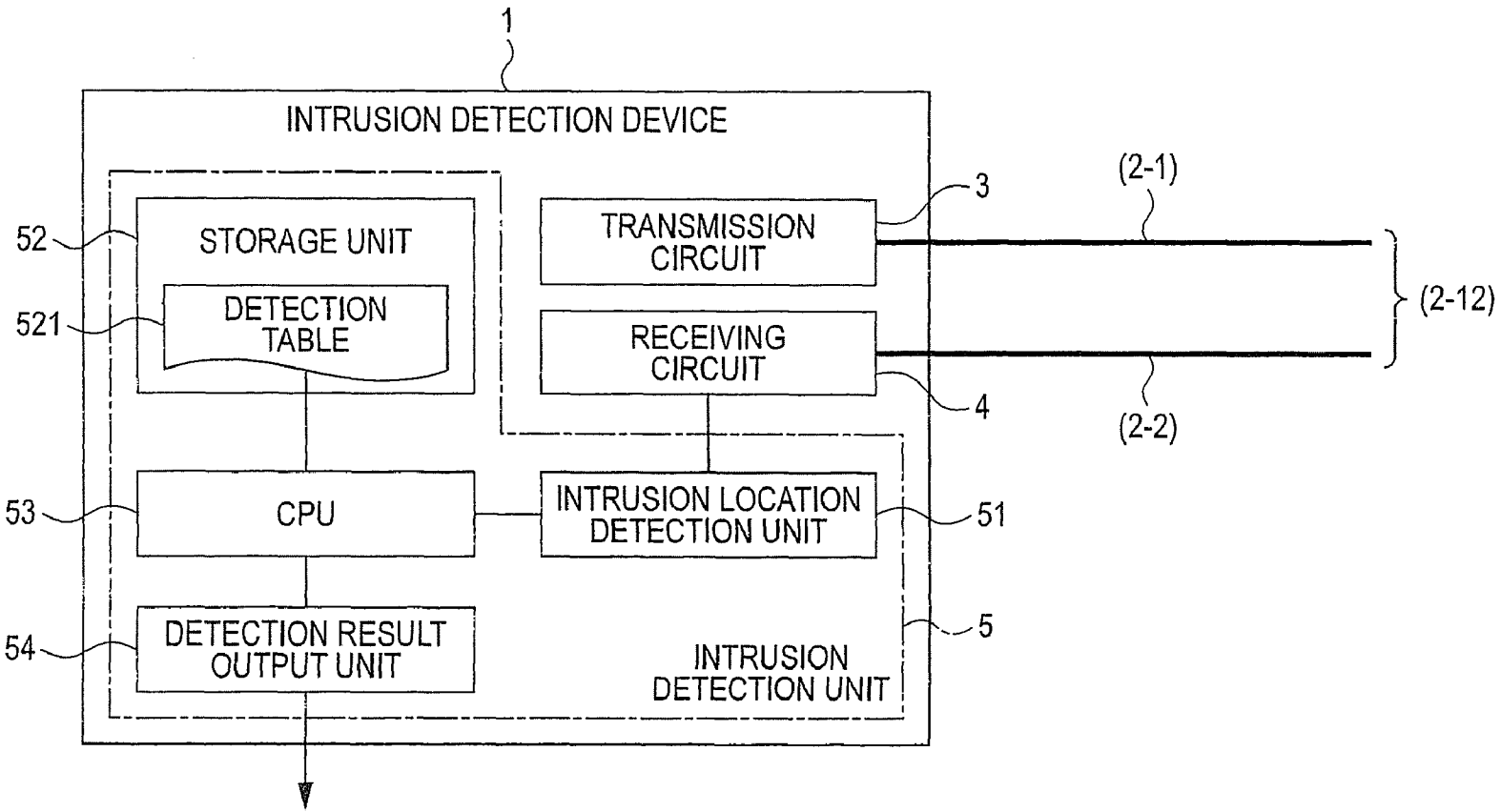
FIG. 4 is a block diagram illustrating an example of an inner configuration of an intrusion detection device shown in FIG. 1 according to the first embodiment of the invention.
Figures 5, 6:
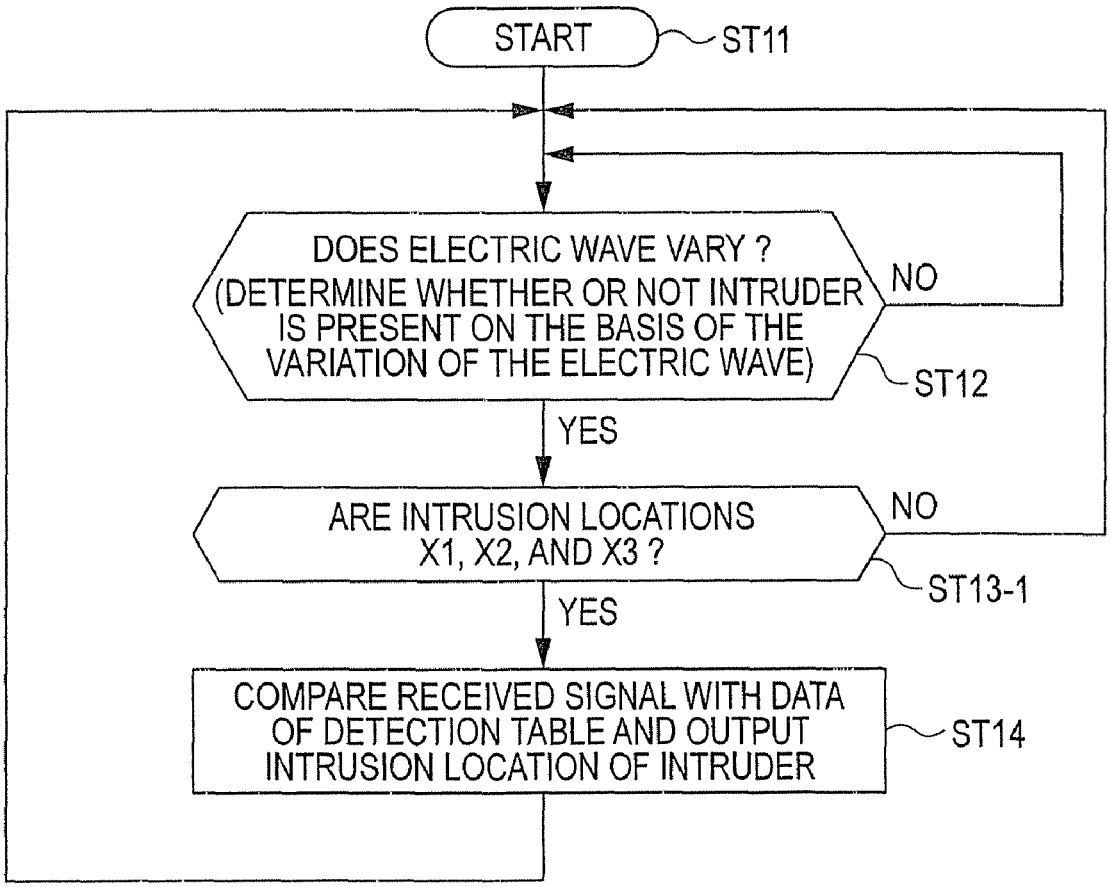
FIG. 5 is a view illustrating an example of a detection table according to the first embodiment of the invention.
FIG. 6 is a flowchart illustrating an example of an operation of the intrusion detection device according to the first embodiment of the invention.

Hereinafter, a first embodiment according to the invention will be described with reference to FIGS. 1 to 6 and FIGS. 7A to 7E. FIG. 1 is a view illustrating an example of a system configuration of an intrusion detection system. FIG. 2 is a view illustrating an example of the concept of detection for an intrusion location. FIG. 3 is a view illustrating a specific example of a transmission signal. FIG. 4 is a block diagram illustrating an example of an inner configuration of an intrusion detection device shown in FIG. 1. FIG. 5 is a view illustrating an example of a detection table. FIG. 6 is a flowchart illustrating an example of an operation of the intrusion detection device. FIGS. 7A to 7E are schematic views illustrating an example of the intrusion detection system in which the intrusion detection device shown in FIGS. 1 and 4 is mounted with analog filters as an anti-disturbing wave function unit.

FIG. 1 shows an intrusion detection system in which an intrusion detection device 1 is connected to a leaky transmission path (2-1) of a sending side and a leaky transmission path (2-2) of a receiving side provided in parallel with the leaky transmission path (2-1) of the sending side. The leaky transmission path (2-2) of the receiving side receives a leaky electric wave from the leaky transmission path (2-1) of the sending side. If an electric wave received in the leaky transmission path (2-2) of the receiving side varies, the intrusion detection system determines that an intruder is present. The leaky transmission path (2-1) of the sending side and the leaky transmission path (2-2) of the receiving side include a plurality of leaky points 21TH, 21TH, 21TH, . . . , 22TH, 22TH, 22TH . . . , existing in a direction to which the respective leaky transmission path extends. The intrusion detection system further includes an intrusion location detection unit 51 (see FIG. 4 which will be described later) which detects an intrusion location of an intruder on the basis of a signal, which is a received signal in a receiving circuit 4 of the receiving side, affected by the leaky electric wave at each of the leaky points 21TH, 21TH, 21TH, . . . , 22TH, 22TH, 22TH . . . . The intrusion detection system further includes a detection table 521 in which a detectable intrusion location is associated with a detection area. If intrusion location detection information of the intrusion location detection unit 51 corresponds to a detection area of the detection table 521, a detection result output unit 54 (see FIG. 4 which will be described later) outputs a detection result.

The intrusion detection device 1 includes a transmission circuit 3, the receiving circuit 4, and an intrusion detection unit 5. The leaky transmission path (2-1) of the sending side and the leaky transmission path (2-2) of the receiving side may be, for example, a commercial leaky coaxial cable. The leaky points 21TH, 21TH, 21TH, . . . , 22TH, 22TH, 22TH, . . . of the leaky transmission path (2-1) of the sending side and the leaky transmission path (2-2) of the receiving side may be, for example, penetration slots provided so as to penetrate an outer cover of the commercial leaky coaxial cable at predetermined intervals of every few meters.

Here, an example for concept of detection of an intrusion location will be described.

It is assumed that a commercial leaky coaxial cable is used as the leaky transmission path (2-1) of the sending side and the leaky transmission path (2-2) of the receiving side, and the leaky transmission path (2-1) of the sending side and the leaky transmission path (2-2) of the receiving side are buried while being separated at predetermined intervals of every few meters. As shown in FIG. 2, for example, when one transmission pulse is transmitted from the transmission circuit 3, a leaky electric wave from a first (initial) leaky point (penetration slot) of the leaky transmission path (2-1) of the sending side is received through a first (initial) leaky point (penetration slot) of the leaky transmission path (2-2) of the receiving side and arrives in the receiving circuit 4 as a received signal. An arrival time of the leaky electric wave is the time taken from the starting time of signal transmission to a $\Delta T1$ point.

In the same way, when one transmission pulse is transmitted from the transmission circuit 3, a leaky electric wave from a second leaky point of the leaky transmission path (2-1) of the sending side is received through a second leaky point of the leaky transmission path (2-2) of the receiving side and arrives in the receiving circuit 4 as a received signal. An arrival time of the leaky electric wave is the time taken from the starting time of signal transmission to a $\Delta T2$ point.

In the same way, an arrival time of a received signal which passes through a third leaky point is the time taken from the starting time of signal transmission to a $\Delta T3$ point.

Further, since a propagation rate of a signal is calculated by 300000 Km/second (in the case of the air), if the length of the signal transmission path is known, the arrival times $\Delta T1$, $\Delta T2$, $\Delta T3$, . . . , that is, the arrival time $\Delta T$ can be easily acquired by using the above operation.

Therefore, by storing data of the arrival time $\Delta T$ calculated beforehand when configuring the system, the receiving circuit 4 can distinguish which leaky point (penetration slot) is passed through by the corresponding received signal by comparing the actually received signal with the stored data.

In addition, when an intruder enters a region where the leaky electric wave exists, a form of the leaky electric wave varies in response to the intruder.

Accordingly, if the intrusion detection unit 5 detects that the signal received in the receiving circuit 4 varies, it is possible to detect and inform an intrusion location along the leaky transmission path (2-1) of the sending side and the leaky transmission path (2-2) of the receiving side.

Since a signal speed is very high and a detection operation speed of the receiving circuit is related to the signal speed, a unit pulse is not transmitted once every few seconds as the transmission signal. For example, as shown in FIG. 3, it is possible to improve detection accuracy by using a coded signal having a few million random pulse strings, such as a PN code that is a pseudo noise spreading code. It is preferable to repeatedly transmit the same PN codes or sequentially transmit different PN codes. The PN code is generally well-known code.

When the PN code is used in the intrusion detection system shown in FIG. 1, the intrusion detection device 1 modulates a phase of a carrier wave having a high frequency as an output of the transmission circuit 3 which generates a spreading code and outputs the modulated carrier wave to the leaky transmission path (2-1) of the sending side. The electric wave output from the leaky transmission path (2-1) of the sending side is received in the leaky transmission path (2-2) of the receiving side, passes through the receiving circuit 4, and then is sent to the intrusion detection unit 5. In the intrusion detection unit 5, phases of the received electric wave are measured with a reference spreading code related to an intrusion distance (referred to as 'demodulation'). Intrusion detection corresponding to the intrusion distance is performed as the electric intensity of the received electric wave obtained as a measurement result varies.

The intrusion detection system has a leaky transmission path (2-1) of a sending side and a leaky transmission path (2-2) of a receiving side that is provided in parallel with the leaky transmission path (2-1) of the sending side and receives a leaky electric wave from the leaky transmission path (2-1) of a sending side, and determines that an intruder is present when an electric wave received in the leaky transmission path (2-2) of the receiving side varies. In an investigation performed by the inventors of the invention, the leaky transmission paths (2-1) and (2-2) are buried while being separated about 600 m and it has been understood that it is possible to detect whether or not an intruder is present between the leaky transmission paths (2-1) and (2-2) and the intrusion location over a long distance such as 600 m.

If it is possible to detect whether or not an intruder is present and the intrusion location over a long distance such as about 600 m, the intrusion detection system can be applied to a factory, transformer substation, airport, parking lot, and so on. However, when the detection can be performed over a long distance such as about 600 m, there may be, for example, a gate for the general public or a general road in a detection region. In this case, the system should be designed to be able to distinguish between an intruder and a person passing through the gate for the general public or the general road by setting a non-detection region. For example, the leaky electric wave may be corrupted in accordance with the person passing through the gate for the general public or the general road such that the received signal varies. In this case, there should be a process for distinguishing between an intruder and the person passing through the gate for the general public or the general road.

Therefore, in the first embodiment according to the invention, as shown in FIG. 4, the intrusion detection unit 5 of the intrusion detection device 1 includes a storage unit 52 which stores a detection table 521 so as to set a non-detection area in addition to the intrusion location detection unit 51. A CPU 53 compares information of an intrusion location detected by the intrusion location detection unit 51 with information set beforehand in the detection table 521. If the information of the intrusion location detected by the intrusion location detection unit 51 does not correspond to the detection region set in the detection table 521, a detection result output unit 54 does not output the detection result.

FIG. 5 is a diagram illustrating a specific example of the detection table 521.

In FIG. 1 described above and FIG. 5, reference symbols X1, X2, and X3 denote a detection region (location) in which it is necessary to detect an intruder. Reference symbols Y1 and Y2 denote a non-detection region (location) in which it is not necessary to detect an intruder. In the detection table 521 shown in FIG. 5, the detectable intrusion locations X1, X2, X3, Y1, and Y2 are associated with a detection area and a non-detection area.

When intrusion location detection information in the intrusion location detection unit 51 corresponds to a detection area of the detection table 521, a detection result is output from the detection result output unit 54. When the intrusion location detection information corresponds to a non-detection area of the detection table 521, the detection result is not output from the detection result output unit 54.

Next, operations will be explained with reference to FIGS. 1 and 4 by using an operation flow chart shown in FIG. 6.

If an intruder enters between the leaky transmission paths (2-1) and (2-2) shown in FIG. 1, the intrusion detection device 1 determines whether or not an electric wave varies. As a result, the intrusion detection device 1 determines whether or not an intruder is present on the basis of the variation of the electric wave (step ST12 of FIG. 6).

As a result of a determination at step ST12 of FIG. 6, when the electric wave varies (when an intruder is present), the intrusion location detection unit 51 (see FIG. 4) detects if intrusion locations are X1, X2, and X3 (step ST13-1).

Next, a received signal (intrusion location detection information in the intrusion location detection unit) detected in step ST13-1 is compared with data of the detection table 521. In the case of intrusion detection in the intrusion detection area, it is conclusively determined that an intruder is present and the detection result output unit 54 outputs an intrusion location of the intruder (step ST14).

Further, in the case that the PN code is used, the detection areas X1, X2, and X3 are associated with the reference spreading code. For example, the detection area X1 is included in a range of a predetermined reference spreading code PNX1 to a predetermined reference spreading code PNXX.

Phases of the received electric wave is measured with a predetermined reference spreading code and an electric intensity corresponding to a predetermined reference spreading code is calculated. When it is determined that the electric intensity largely varies, it is considered as an intrusion in the predetermined reference spreading code, that is, an intrusion in the detection area X1.

In the first embodiment of the invention, as described above, the intrusion can be easily and precisely detected by comparing with the detection table 521. In addition, the detection area and the non-detection area can be set and the setting of the detection area and the non-detection area can be changed. Further, it is possible to detect the intrusion over a long distance, for example, intervals at every 2 m or 5 m. Accordingly, an applicable region of the intrusion detection system can be remarkably large.

In addition, in the first embodiment of the invention, as shown in FIG. 1, the intrusion detection device 1 modulates the phase of the carrier wave having the high frequency in the transmission circuit 3 and outputs the modulated carrier wave to the leaky transmission path (2-1). The electric wave output from the leaky transmission path (2-1) is received in the leaky transmission path (2-2), and then sent to the receiving circuit 4. Subsequently, the electric wave sent to the receiving circuit 4 is sent to the intrusion detection unit 5. In the intrusion detection unit 5, the phases of the received electric wave are measured with the reference spreading code related to the intrusion distance (demodulation). The intrusion detection corresponding to the intrusion distance is performed as the electric intensity of the received electric wave varies (that is, it is detected presence or absence of intrusion and the intrusion point).

FIGS. 7A to 7E are the schematic views illustrating the example of the intrusion detection system in which the intrusion detection device 1 shown in FIGS. 1 and 4 is mounted with the analog filters as the anti-disturbing wave function unit.

Figure 7A:
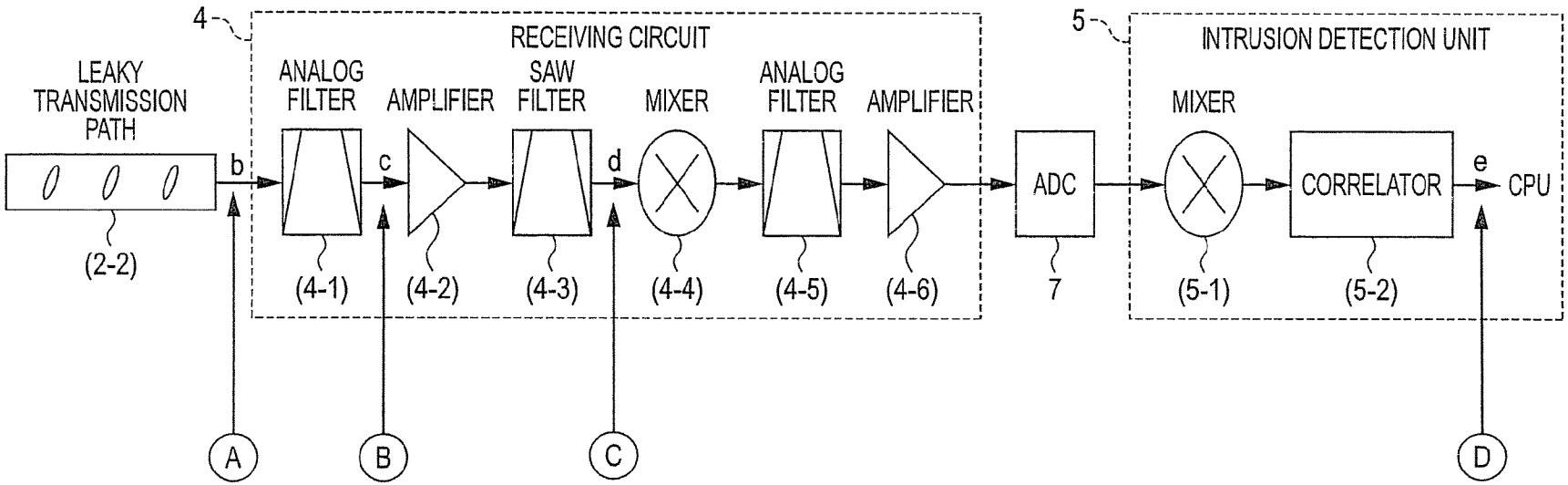
FIGS. 7A to 7E are schematic views illustrating an example of the intrusion detection system in which the intrusion detection device shown in FIGS. 1 and 4 is mounted with analog filters as an anti-disturbing wave function unit according to the first embodiment of the invention.

In the first embodiment of the invention, as shown in FIG. 7A, the receiving circuit 4 of the intrusion detection device 1, which is connected to the leaky transmission path (2-2), is mounted with analog filters (4-1), (4-3), and (4-5) as the anti-disturbing wave function unit so as to remove/reduce a disturbing wave.

The receiving circuit 4 is an analog circuit and the intrusion detection unit 5 is a digital circuit. For this reason, an AD converter 7 is provided between both the circuits to convert an analog signal to a digital signal.

Figure 7B:
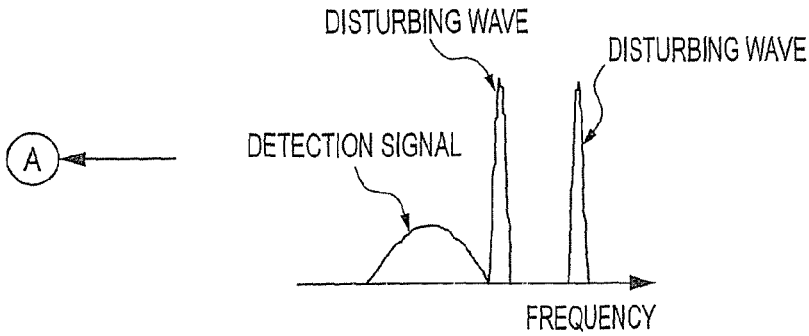

As shown in FIG. 7B, an output (point b in FIG. 7A) from the leaky transmission path (2-2) receiving a disturbing wave has a waveform, as shown in FIG. 7B, in which one disturbing wave is present near a detection signal and another disturbing wave is present at a slightly high frequency.

Figure 7C:
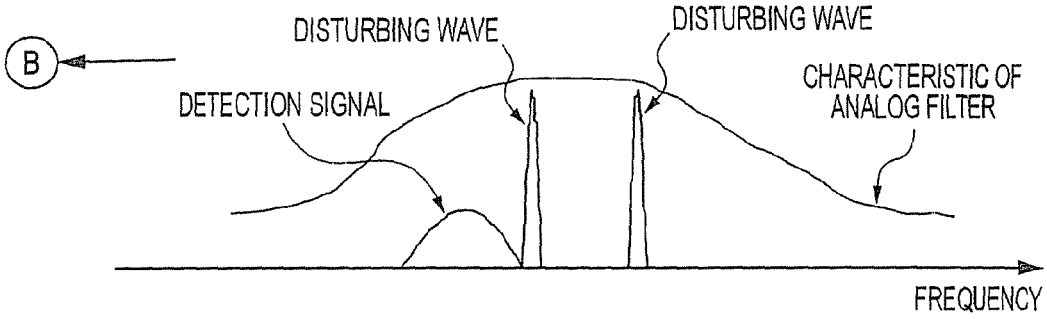

As shown in FIG. 7C, the analog filter (4-1) is disposed across the frequency band including the detection signal and the two disturbing waves to cause subsequent signal processes to be narrowed to this band.

An amplifier (4-2) is an amplifier for circuit matching. A mixer (4-4) converts the frequency. The analog filter (4-5) removes signals having an unnecessary frequency from signals of which frequencies vary in the mixer (4-4).

The SAW filter (4-3) is disposed so as to be precipitous in the band including the detection signal and one disturbing wave near the detection signal as compared with the case of analog filter (4-1). Therefore, the disturbing wave at the high frequency is suppressed, as shown in FIG. 7D.

Figure 7D:
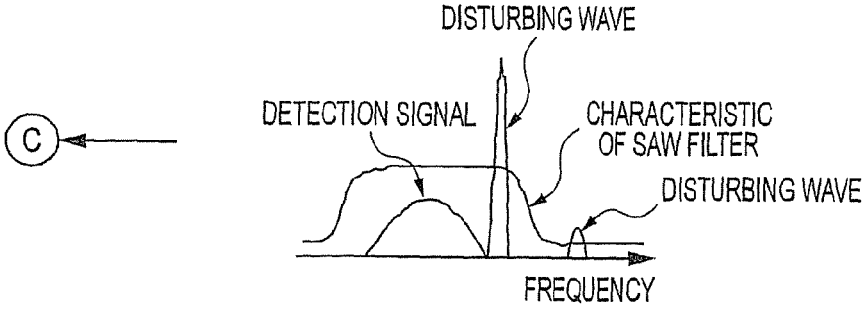
Figure 7E:
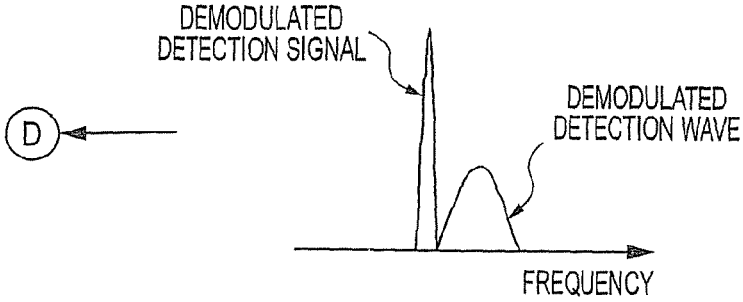

As shown in FIG. 7D, the disturbing wave which is slightly away from the detection signal is suppressed by the SAW filter (4-3). However, the disturbing wave near the detection signal passes. The passing disturbing wave is demodulated in the intrusion detection unit 5 and is suppressed, as shown in FIG. 7E. In this case, as shown in FIG. 7E, a strong disturbing wave can affect detection performance.

In addition, in order to input the detection signal to the intrusion detection unit 5 which is the digital circuit by an amplifier (4-6), the detection signal is output to the AD converter 7 after being properly amplified.

Further, in a mixer (5-1) of the intrusion detection device 5, the frequency of the detection signal is converted into baseband frequency so that the detection signal can be analyzed by a correlator (5-2).

As described above, according to the first embodiment, it is possible to reduce the disturbing wave.

In addition, in the first embodiment of the invention, the intrusion detection system which can remove/reduce the disturbing wave by the analog filters of the receiving circuit 4 and the demodulation can be obtained.

Second Embodiment

Hereinafter, a second embodiment according to the invention will be described with reference to FIGS. 8A to 8E, which are schematic views illustrating another example of the intrusion detection system in which the intrusion detection device is mounted with the anti-disturbing wave function unit.

In the above-described first embodiment of the invention, the configuration of the intrusion detection system which removes/reduces the disturbing wave by the analog filters as the anti-disturbing wave function unit provided in the receiving circuit has been described. In the second embodiment of the invention, as shown in FIGS. 8A to 8E, a digital filter (5-3) as the anti-disturbing wave function unit is mounted on the intrusion detection unit 5 in the intrusion detection system shown in FIGS. 7A to 7E to further remove/reduce the disturbing wave. An IIR (Infinite Impulse Response) filter with low filter order and a large attenuation amount is used as the digital filter (5-3).

The basic operations of the intrusion detection system having an anti-disturbing wave function are equal to those described in the first embodiment of the invention.

FIGS. 8A to 8E illustrate the intrusion detection system using the analog filters (4-1), (4-3), and (4-5) and the digital filter (5-3).

Figure 8A:
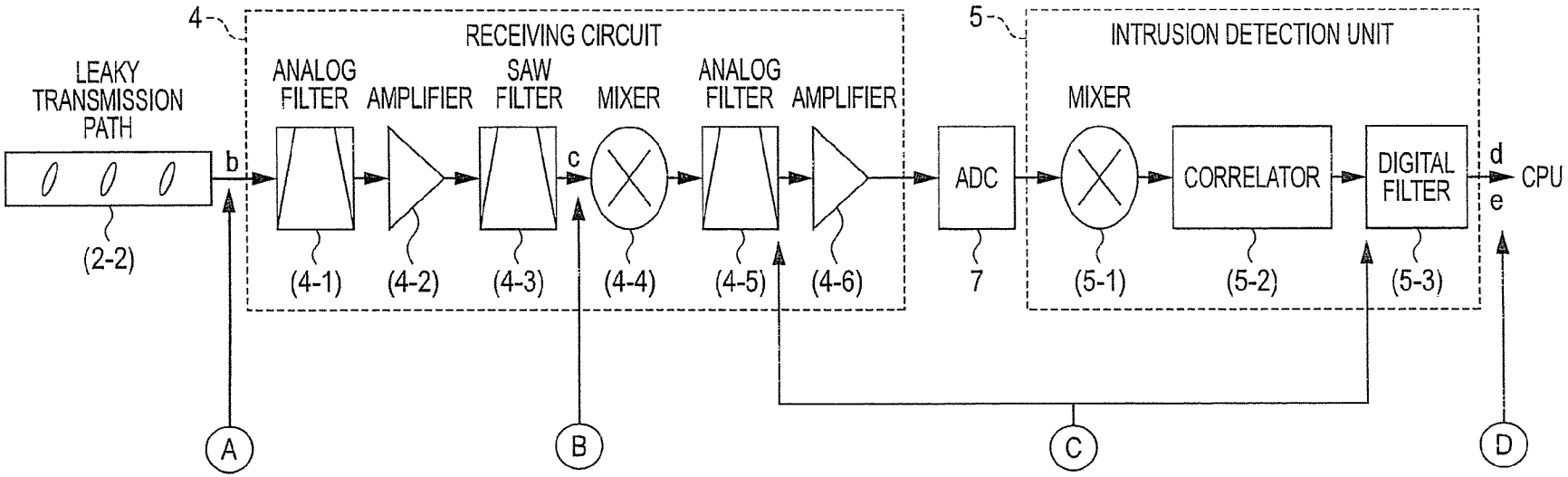
FIGS. 8A to 8E are schematic views illustrating another example of the intrusion detection system in which the intrusion detection device is mounted with the anti-disturbing wave function unit according to a second embodiment of the invention.
Figure 8B:
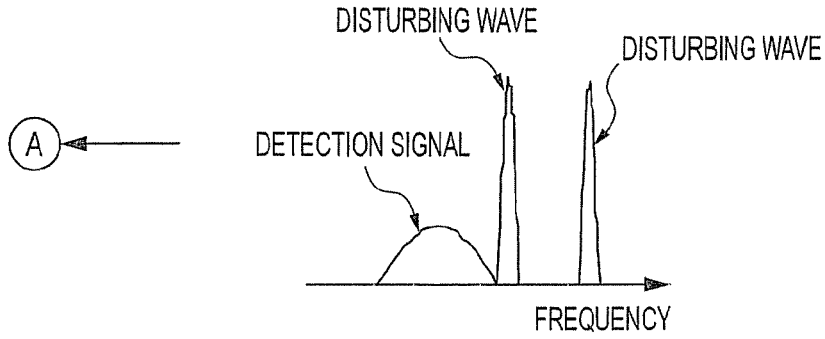
Figure 8C:
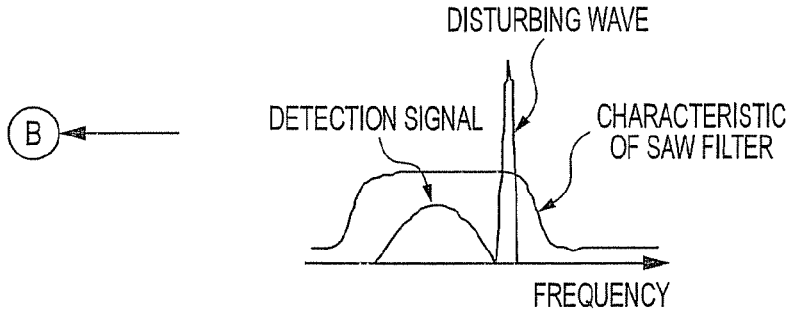
Figure 8D:
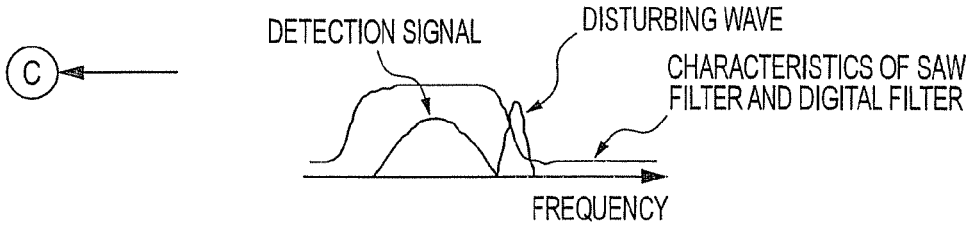

In this case, the disturbing wave which can not be removed/reduced by the analog filters (4-1), (4-3), and (4-5) can be further suppressed by the digital filter (5-3), as shown in FIG. 8D.

Figure 8E:
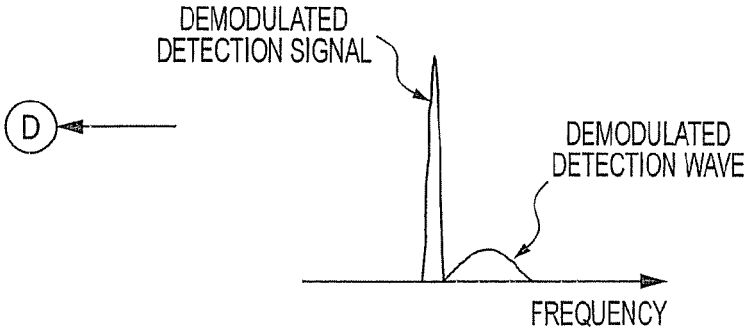

As shown in FIG. 8D, the analog filter (4-1), the SAW filter (4-3), and the analog filter (4-5) are provided in the receiving circuit 4, and the digital filter (5-3) is provided between the correlator (5-2) and the CPU (the CPU 53 shown in FIG. 4). Accordingly, as shown in FIG. 8E, since the disturbing wave near the detection signal is further suppressed, the detection performance is not affected.

In the second embodiment of the invention, the intrusion detection system which can remove/reduce the disturbing wave can be obtained even when it is mounted with the digital filter (5-3).

Third Embodiment

Hereinafter, a third embodiment according to the invention will be described with reference to FIGS. 9A to 9E, which are schematic views illustrating further another example of the intrusion detection system in which the intrusion detection device is mounted with the anti-disturbing wave function unit.

In the above-described first embodiment of the invention, the configuration of the intrusion detection system which removes/reduces the disturbing wave by the analog filters as the anti-disturbing wave function unit provided in the receiving circuit has been described. In the third embodiment of the invention, as shown in FIGS. 9A to 9E, the digital filter (5-3) as the anti-disturbing wave function unit is mounted on the intrusion detection unit 5 in the intrusion detection system shown in FIGS. 7A to 7E to further remove/reduce the disturbing wave. A FIR (Finite Impulse Response) filter with constant group delay and without unique resonance frequency is used as the digital filter (5-3).

The basic operations of the intrusion detection system having the anti-disturbing wave function are equal to those described in the first embodiment of the invention.

FIGS. 9A to 9E illustrate the intrusion detection system using the analog filters (4-1), (4-3), and (4-5) and the digital filter (5-3).

Figure 9A:
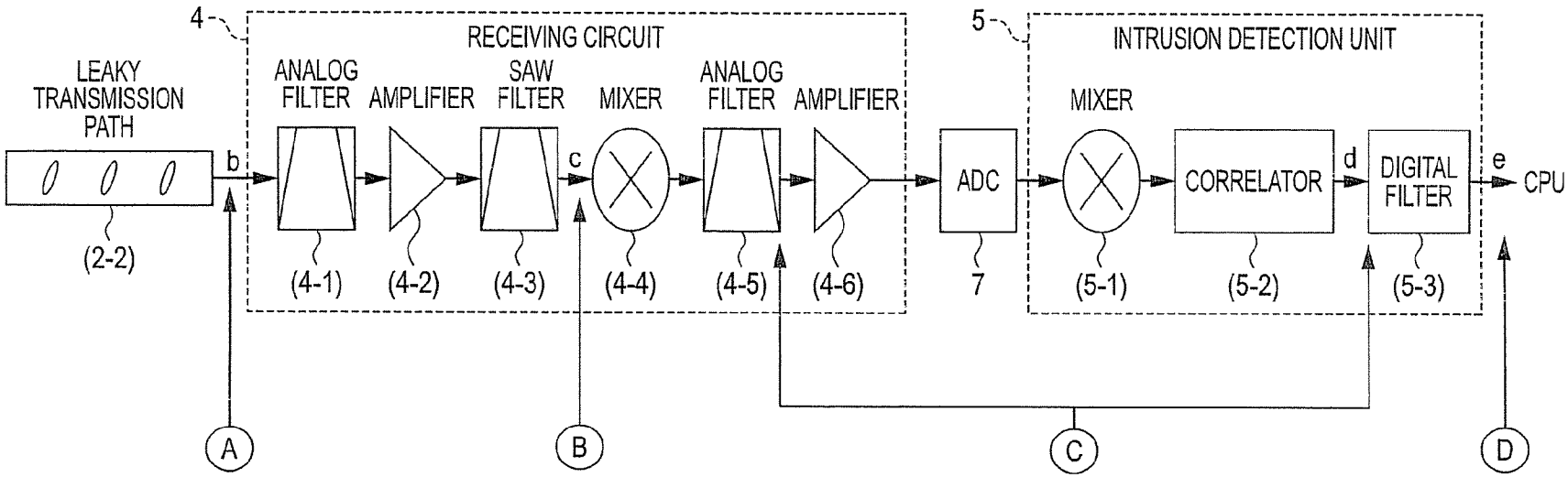
FIGS. 9A to 9E are schematic views illustrating further another example of the intrusion detection system in which the intrusion detection device is mounted with the anti-disturbing wave function unit according to a third embodiment of the invention.
Figure 9B:
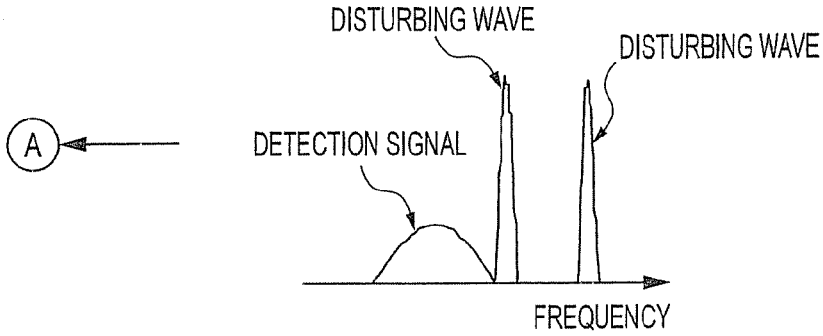
Figure 9C:
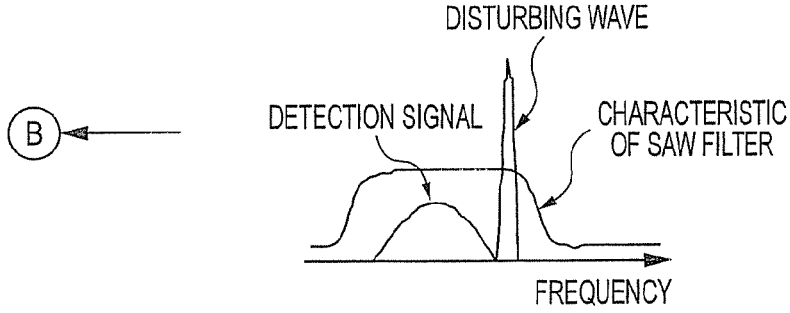
Figure 9D:
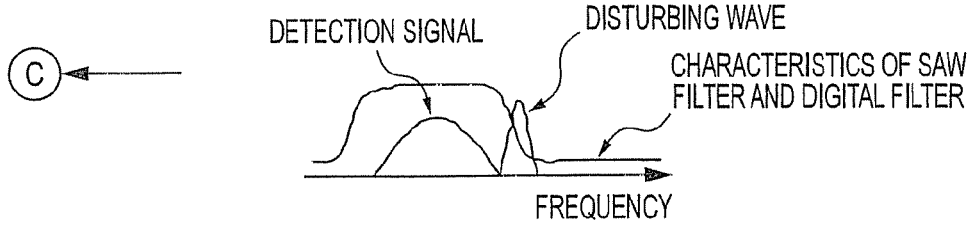
Figure 9E:
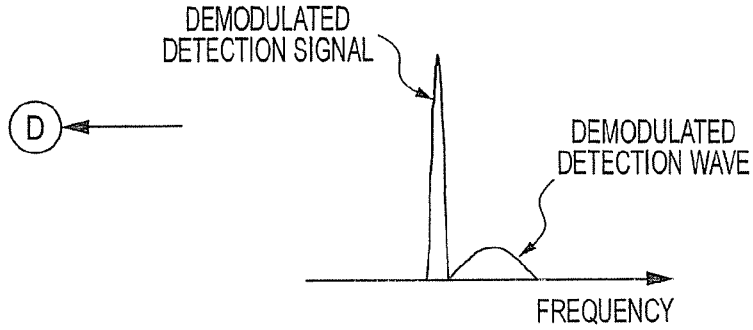
Figure 10A:
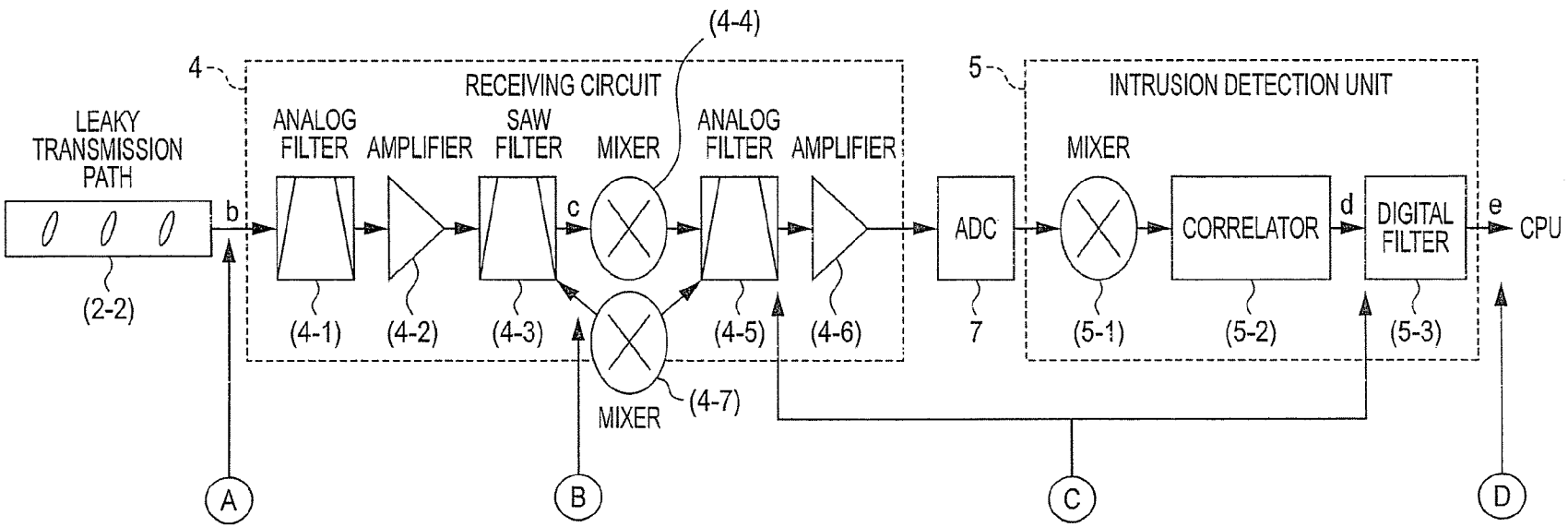
FIGS. 10A to 10E are schematic views illustrating still further another example of the intrusion detection system in which the intrusion detection device is mounted with the anti-disturbing wave function unit according to a fourth embodiment of the invention.
Figure 10B:
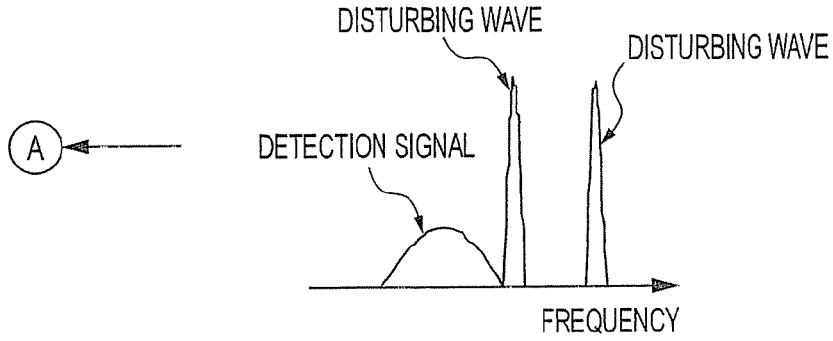
Figure 10C:
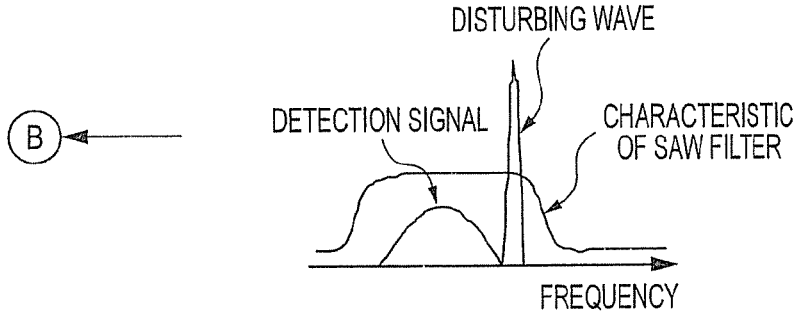
Figure 10D:
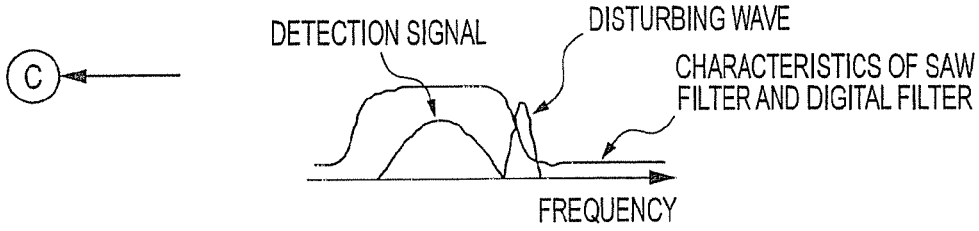
Figure 10E:
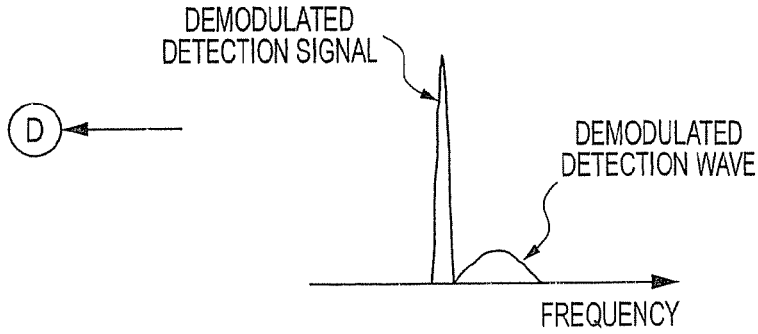

In this case, the disturbing wave which can not be removed/reduced by the analog filter (4-1), SAW filter (4-3), and the analog filter (4-5) can be further suppressed by the digital filter (5-3), as shown in FIG. 9D.

As shown in FIG. 9D, the analog filters (4-1), (4-3), and (4-5) are provided in the receiving circuit 4, and a digital filter (5-1) is provided between the correlator (5-2) and the CPU (the CPU 53 shown in FIG. 4). Accordingly, as shown in FIG. 8E, since the disturbing wave near the detection signal is further suppressed, the detection performance is not affected.

In the third embodiment of the invention, the intrusion detection system which can remove/reduce the disturbing wave can be obtained even when it is mounted with the digital filter (5-3).

Fourth Embodiment

Hereinafter, a fourth embodiment according to the invention will be described with reference to FIGS. 10A to 10E, which are schematic views illustrating still further another example of the intrusion detection system in which the intrusion detection device is mounted with the anti-disturbing wave function unit.

In the above-described first embodiment of the invention, the configuration of the intrusion detection system which removes/reduces the disturbing wave by the analog filters as the anti-disturbing wave function unit provided in the receiving circuit has been described. In the fourth embodiment of the invention, as shown in FIGS. 10A to 10E, the analog filters (4-1), (4-3), and (4-5) as the anti-disturbing wave function unit are mounted on the receiving circuit 4, and the digital filter (5-3) as the anti-disturbing wave function unit are mounted on the intrusion detection unit 5 in the intrusion detection system shown in FIGS. 7A to 7E. When the disturbing wave is present near the detection signal, the disturbing wave is kept outside the bands of the filters. Accordingly, the plurality of the mixers (4-4) and (4-7) are mounted to switch the frequency of the detection signal, and thus the disturbing wave can be further removed/reduced.

The basic operations of the intrusion detection system having the anti-disturbing wave function are equal to those described in the first embodiment of the invention.

FIGS. 10A to 10E illustrate the intrusion detection system using the analog filters (4-1), (4-3), and (4-5), the digital filter (5-3), and the plurality of the mixers (4-4) and (4-7).

In this case, the disturbing wave in the frequency range of the detection signal, which has not been removed/reduced by the analog filters (4-1), (4-3), and (4-5), and the digital filter (5-3) at the frequency near the detection signal, is varied in frequency by the plurality of the mixers (4-4), and (4-7). The disturbing wave can be kept outside the passing band and can be suppressed.

In the fourth embodiment of the invention, the intrusion detection system which can remove/reduce the disturbing wave can be obtained even when it is mounted with the plurality of the mixers (4-4) and (4-7).

Fifth Embodiment

Figure 11A:
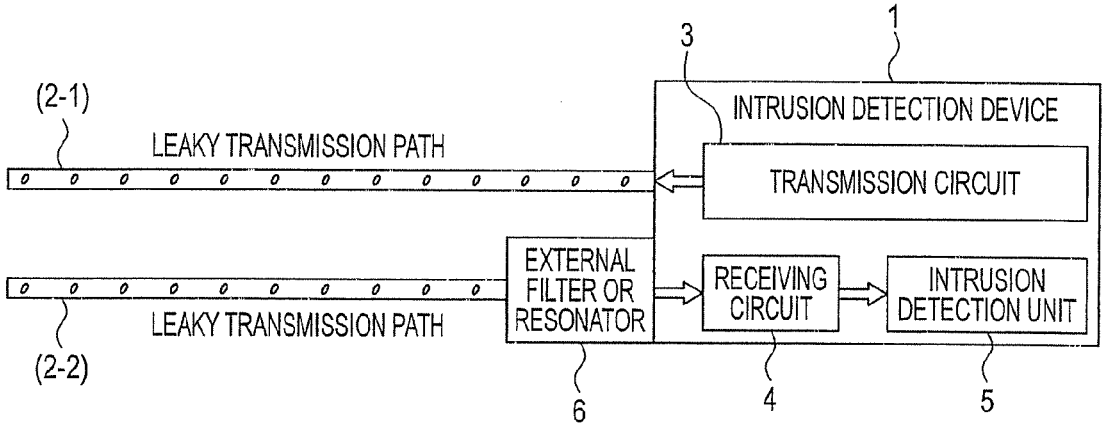
FIGS. 11A and 11B are schematic views illustrating yet further another example of the intrusion detection system in which the intrusion detection device is mounted with the anti-disturbing wave function unit according to the first embodiment of the invention.
Figure 11B:
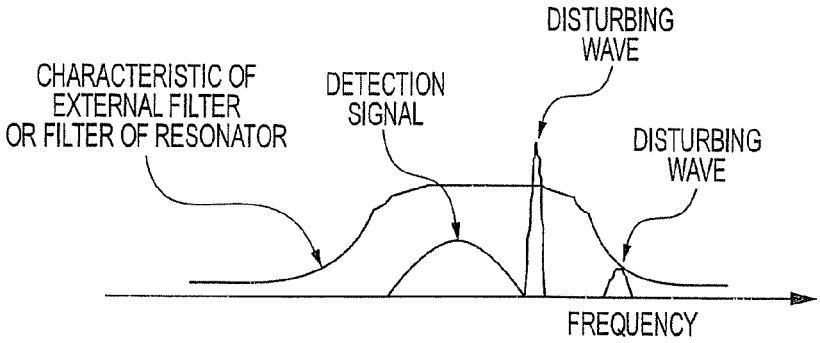

Hereinafter, a fifth embodiment according to the invention will be described with reference to FIGS. 11A and 11B, which are schematic views illustrating yet further another example of the intrusion detection system in which the intrusion detection device is mounted with the anti-disturbing wave function unit.

In the above-described first embodiment of the invention, the configuration of the intrusion detection system which removes/reduces the disturbing wave by the analog filters of the receiving circuit has been described. In the fifth embodiment of the invention, as shown in FIG. 11A, an external filter or resonator 6 is connected between the leaky transmission path (2-2) and the intrusion detection device 1 to remove/reduce the disturbing wave. A cavity resonator or a dielectric resonator, which has small loss, is used as the external filter or resonator 6.

The basic operations of the intrusion detection system having the anti-disturbing wave function are equal to those described in the first embodiment of the invention.

In the fifth embodiment of the invention, the intrusion detection device 1 without the digital filter (5-3) can suppress the disturbing wave by the external resonator 6.

In the fifth embodiment of the invention, the intrusion detection system which can remove/reduce the disturbing wave can be obtained even when it is mounted with the external filter or resonator 6.

Technical characteristics according to the first to fifth embodiments of the invention are as the following Features 1 to 18 and the like.

Feature 1-1 is an intrusion detection system including: an intrusion detection device; and a pair of leaky transmission paths including a leaky transmission path of a sending side, connected to the intrusion detection device, for emitting a leaky electric wave supplied by the intrusion detection device and a leaky transmission path of a receiving side for receiving the leaky electric wave emitted from the leaky transmission path of the sending side. The intrusion detection device detects an intrusion and its point from a variation of the leaky electric wave received in the leaky transmission path of the receiving side. An anti-disturbing wave function unit for removing or reducing a disturbing wave intruding into the leaky transmission path of the receiving side is provided, in the intrusion detection device, so that the intrusion detection device determines the intrusion and its point using the leaky electric wave processed by the anti-disturbing wave function unit.

Feature 1-2 is an intrusion detection system including: an intrusion detection device; and a pair of leaky transmission paths including a leaky transmission path of a sending side which is connected to the intrusion detection device and outputs a leaky electric wave on the basis of an output from the intrusion detection device and a leaky transmission path of a receiving side which receives the leaky electric wave output from the leaky transmission path of the sending side. The intrusion detection device detects that the leaky electric wave received in the leaky transmission path of the receiving side varies to detect the presence or absence of intrusion and an intrusion point. An anti-disturbing wave function unit for removing or reducing a disturbing wave intruding into the leaky transmission path of the receiving side is provided, in the intrusion detection device, at a position in which the disturbing wave is removed or reduced by the anti-disturbing wave function unit before the intrusion detection device determines the presence or absence of intrusion and the intrusion point.

Feature 2 is the intrusion detection system according to Feature 1-1 or Feature 1-2, A received an analog signal which is an intrusion detection wave input from the leaky transmission path of the receiving side to the intrusion detection device is converted into a digital signal in the intrusion detection device. The intrusion determination is performed on the basis of the digital signal. The anti-disturbing wave function unit includes an anti-disturbing wave filter for at least one of the received analog signal and the digital signal.

Feature 3 is the intrusion detection system according to Feature 2, A plurality of the anti-disturbing wave filters having different filter characteristics are provided as the anti-disturbing wave filter for the received analog signal, and a plurality of the disturbing waves having different frequencies are removed or reduced by the plurality of the anti-disturbing wave filters.

Feature 4 is the intrusion detection system according to Feature 3, A SAW filter is provided as one of the plurality of the anti-disturbing wave filters having different filter characteristics, and a disturbing wave having a frequency higher than that of the received analog signal is removed or reduced by the SAW filter.

Feature 5 is the intrusion detection system according to Feature 1-1 or Feature 1-2, A received analog signal input from the leaky transmission path of the receiving side to the intrusion detection device is converted into a digital signal in the intrusion detection device. The intrusion determination is performed on the basis of the digital signal. The anti-disturbing wave function unit includes at least one analog anti-disturbing wave filter for the received analog signal and a digital anti-disturbing wave filter for the digital signal. An infinite impulse response digital filter is provided as the digital anti-disturbing wave filter.

Feature 6 is the intrusion detection system according to Feature 1-1 or Feature 1-2, A received analog signal input from the leaky transmission path of the receiving side to the intrusion detection device is converted into a digital signal in the intrusion detection device. The intrusion determination is performed on the basis of the digital signal. The anti-disturbing wave function unit includes at least one analog anti-disturbing wave filter for the received analog signal and a digital anti-disturbing wave filter for the digital signal. A finite impulse response digital filter is provided as the digital anti-disturbing wave filter.

Feature 7 is the intrusion detection system according to Features 1-1 or Feature 1-2, to 6, An external filter is provided at a front stage of a receiving unit of the intrusion detection device, and the disturbing wave is removed or reduced by the external filter.

Feature 8 is the intrusion detection system according to Features 1-1 or Feature 1-2, to 6, An external resonator is provided at a front stage of a receiving unit of the intrusion detection device, and the disturbing wave is removed or reduced by the external resonator.

Feature 9 is the intrusion detection system according to Features 1-1 or Feature 1-2, to 6, The intrusion detection device has a function of varying the frequency of the received analog signal input from the leaky transmission path of the receiving side to the intrusion detection device.

Feature 10-1 is an intrusion detection system including: a pair of leaky transmission paths including a leaky transmission path of a sending side for emitting a leaky electric wave and a leaky transmission path of a receiving side, provided in parallel with the leaky transmission path of the sending side, for receiving the leaky electric wave emitted from the leaky transmission path of the sending side; and an intrusion detection device including a transmission circuit for outputting a predetermined electric signal to the leaky transmission path of the sending side, a receiving circuit for receiving the leaky electric wave received by the leaky transmission path of the receiving side, and an intrusion detection unit for detecting an its point from a variation of the leaky electric wave received by the receiving circuit. The intrusion detection device includes an anti-disturbing wave function unit for processing the signal received by the receiving circuit for removing or reducing a disturbing wave received by the leaky transmission path of the receiving side and for outputting the processed signal to the intrusion detection unit.

Feature 10-2 is an intrusion detection system including: a pair of leaky transmission paths including a leaky transmission path of a sending side from which an electric wave leaks and a leaky transmission path of a receiving side which is provided in parallel with the leaky transmission path of the sending side and receives the electric wave leaking from the leaky transmission path of the sending side; and an intrusion detection device including a transmission circuit which outputs a predetermined electric signal to the leaky transmission path of the sending side, a receiving circuit which receives the leaky electric wave received by the leaky transmission path of the receiving side, and an intrusion detection unit which detects the presence or absence of intrusion and an intrusion point by the variation of the leaky electric wave received by the receiving circuit. The intrusion detection device includes an anti-disturbing wave function unit which processes the signal received by the receiving circuit for removing or reducing a disturbing wave received by the leaky transmission path of the receiving side and outputs the processed signal to the intrusion detection unit.

Feature 11 is the intrusion detection system according to Feature 10, The intrusion detection device includes an analog/digital converter which converts a received analog signal received by the receiving circuit from the leaky transmission path of the receiving side into a digital signal. The digital signal is input to the intrusion detection unit. The anti-disturbing wave function unit includes at least one anti-disturbing wave filter for processing the received analog signal or the digital signal.

Feature 12 is the intrusion detection system according to Feature 11, A plurality of the anti-disturbing wave filters having different filter characteristics are provided as the anti-disturbing wave filter for processing the received analog signal, and a plurality of the disturbing waves having different frequencies are removed or reduced by the plurality of the anti-disturbing wave filters.

Feature 13 is the intrusion detection system according to Feature 12, A SAW filter is provided as one of the plurality of the anti-disturbing wave filters having different filter characteristics.

Feature 14 is the intrusion detection system according to Feature 11, The anti-disturbing wave function unit includes at least one anti-disturbing wave filter for processing the received analog signal and an infinite impulse response digital filter as the anti-disturbing wave filter for processing the digital signal.

Feature 15 is the intrusion detection system according to Feature 11, The anti-disturbing wave function unit includes at least one anti-disturbing wave filter for processing the received analog signal and a finite impulse response digital filter as the anti-disturbing wave filter for processing the digital signal.

Feature 16 is the intrusion detection system according to Features 10 to 15, An external filter is provided between the leaky transmission path of the receiving side and the intrusion detection device to remove or reduce the disturbing wave.

Feature 17 is the intrusion detection system according to Features 10 to 15, An external resonator is provided between the leaky transmission path of the receiving side and the intrusion detection device to remove or reduce the disturbing wave.

Feature 18 is the intrusion detection system according to Features 10 to 15, The intrusion detection device has a function of varying the frequency of the received analog signal input from the leaky transmission path of the receiving side.

Various modifications and alterations of this invention will be apparent to those skilled in the art without departing from the scope and spirit of this invention, and it should be understood that this is not limited to the illustrative embodiments set forth herein.

What is claimed is:

1. An intrusion detection system comprising:

an intrusion detection device; and a pair of separated leaky transmission paths including a leaky transmission path of a sending side, connected to the intrusion detection device, for emitting a leaky electric wave supplied by the intrusion detection device and a leaky transmission path of a receiving side for receiving the leaky electric wave emitted from the leaky transmission path of the sending side, wherein the intrusion detection device detects an intrusion between the separated leaky transmission paths and its location from a variation of the leaky electric wave received in the leaky transmission path of the receiving side and has a function unit for varying the frequency of the received analog signal input from the leaky transmission path of the receiving side to the intrusion detection device, and wherein an anti-disturbing wave function unit for removing or reducing a disturbing wave intruding into the leaky transmission path of the receiving side is provided, in the intrusion detection device, so that the intrusion detection device determines the intrusion and its location using the leaky electric wave processed by the anti-disturbing wave function unit.

2. The intrusion detection system according to claim 1, wherein a received analog signal which is an intrusion detection wave input from the leaky transmission path of the receiving side to the intrusion detection device is converted into a digital signal in the intrusion detection device, the intrusion determination is performed on the basis of the digital signal, and the anti-disturbing wave function unit includes an anti-disturbing wave filter for at least one of the received analog signal and the digital signal.

3. The intrusion detection system according to claim 2, wherein a plurality of the anti-disturbing wave filters having different filter characteristics are provided as the anti-disturbing wave filter for the received analog signal, and a plurality of the disturbing waves having different frequencies are removed or reduced by the plurality of the anti-disturbing wave filters.

4. The intrusion detection system according to claim 3, wherein a SAW filter is provided as one of the plurality of the anti-disturbing wave filters having different filter characteristics, and a disturbing wave having a frequency higher than that of the received analog signal is removed or reduced by the SAW filter.

5. The intrusion detection system according to claim 1, wherein an external filter is provided at a front stage of a receiving unit of the intrusion detection device, and the disturbing wave is removed or reduced by the external filter.

6. The intrusion detection system according to claim 1, wherein an external resonator is provided at a front stage of a receiving unit of the intrusion detection device, and the disturbing wave is removed or reduced by the external resonator.

7. An intrusion detection system comprising:

an intrusion detection device; and a pair of separated leaky transmission paths including a leaky transmission path of a sending side, connected to the intrusion detection device, for emitting a leaky electric wave supplied by the intrusion detection device and a leaky transmission path of a receiving side for receiving the leaky electric wave emitted from the leaky transmission path of the sending side, wherein the intrusion detection device detects an intrusion between the separated leaky transmission paths and its location from a variation of the leaky electric wave received in the leaky transmission path of the receiving side, wherein an anti-disturbing wave function unit for removing or reducing a disturbing wave intruding into the leaky transmission path of the receiving side is provided, in the intrusion detection device, so that the intrusion detection device determines the intrusion and its location using the leaky electric wave processed by the anti-disturbing wave function unit, and wherein a received analog signal input from the leaky transmission path of the receiving side to the intrusion detection device is converted into a digital signal in the intrusion detection device, the intrusion determination is performed on the basis of the digital signal, the anti-disturbing wave function unit includes at least one analog anti-disturbing wave filter for the received analog signal and a digital anti-disturbing wave filter for the digital signal, and an infinite impulse response digital filter is provided as the digital anti-disturbing wave filter.

8. An intrusion detection system comprising:

an intrusion detection device; and a pair of separated leaky transmission paths including a leaky transmission path of a sending side, connected to the intrusion detection device, for emitting a leaky electric wave supplied by the intrusion detection device and a leaky transmission path of a receiving side for receiving the leaky electric wave emitted from the leaky transmission path of the sending side, wherein the intrusion detection device detects an intrusion between the separated leaky transmission paths and its location from a variation of the leaky electric wave received in the leaky transmission path of the receiving side, wherein an anti-disturbing wave function unit for removing or reducing a disturbing wave intruding into the leaky transmission path of the receiving side is provided, in the intrusion detection device, so that the intrusion detection device determines the intrusion and its location using the leaky electric wave processed by the anti-disturbing wave function unit, and wherein a received analog signal input from the leaky transmission path of the receiving side to the intrusion detection device is converted into a digital signal in the intrusion detection device, the intrusion determination is performed on the basis of the digital signal, the anti-disturbing wave function unit includes at least one analog anti-disturbing wave filter for the received analog signal and a digital anti-disturbing wave filter for the digital signal, and a finite impulse response digital filter is provided as the digital anti-disturbing wave filter.

9. An intrusion detection system comprising:

a pair of separated leaky transmission paths including a leaky transmission path of a sending side for emitting a leaky electric wave and a leaky transmission path of a receiving side, provided in parallel with the leaky transmission path of the sending side, for receiving the leaky electric wave emitted from the leaky transmission path of the sending side; and an intrusion detection device including a transmission circuit for outputting a predetermined electric signal to the leaky transmission path of the sending side, a receiving circuit for receiving the leaky electric wave received by the leaky transmission path of the receiving side, and an intrusion detection unit for detecting an intrusion between the separated leaky transmission paths and its location from a variation of the leaky electric wave received by the receiving circuit, wherein the intrusion detection device has a function unit for varying the frequency of the received analog signal input from the leaky transmission path of the receiving side and further includes an anti-disturbing wave function unit for processing the signal received by the receiving circuit for removing or reducing a disturbing wave received by the leaky transmission path of the receiving side and for outputting the processed signal to the intrusion detection unit.

10. The intrusion detection system according to claim 9, wherein the intrusion detection device includes an analog/digital converter for converting a received analog signal received by the receiving circuit from the leaky transmission path of the receiving side into a digital signal, the digital signal is input to the intrusion detection unit, and the anti-disturbing wave function unit includes at least one anti-disturbing wave filter for processing the received analog signal or the digital signal.

11. The intrusion detection system according to claim 10, wherein a plurality of the anti-disturbing wave filters having different filter characteristics are provided as the anti-disturbing wave filter for processing the received analog signal, and a plurality of the disturbing waves having different frequencies are removed or reduced by the plurality of the anti-disturbing wave filters.

12. The intrusion detection system according to claim 11, wherein a SAW filter is provided as one of the plurality of the anti-disturbing wave filters having different filter characteristics.

13. The intrusion detection system according to claim 9, wherein an external filter is provided between the leaky transmission path of the receiving side and the intrusion detection device to remove or reduce the disturbing wave.

14. The intrusion detection system according to claim 9, wherein an external resonator is provided between the leaky transmission path of the receiving side and the intrusion detection device to remove or reduce the disturbing wave.

15. An intrusion detection system comprising:

a pair of separated leaky transmission paths including a leaky transmission path of a sending side for emitting a leaky electric wave and a leaky transmission path of a receiving side, provided in parallel with the leaky transmission path of the sending side, for receiving the leaky electric wave emitted from the leaky transmission path of the sending side; and an intrusion detection device including a transmission circuit for outputting a predetermined electric signal to the leaky transmission path of the sending side, a receiving circuit for receiving the leaky electric wave received by the leaky transmission path of the receiving side, and an intrusion detection unit for detecting an intrusion between the separated leaky transmission paths and its location from a variation of the leaky electric wave received by the receiving circuit, wherein the intrusion detection device includes an anti-disturbing wave function unit for processing the signal received by the receiving circuit for removing or reducing a disturbing wave received by the leaky transmission path of the receiving side and for outputting the processed signal to the intrusion detection unit, and wherein the anti-disturbing wave function unit includes at least one anti-disturbing wave filter for processing the received analog signal and an infinite impulse response digital filter as the anti-disturbing wave filter for processing the digital signal.

16. An intrusion detection system comprising:

a pair of separated leaky transmission paths including a leaky transmission path of a sending side for emitting a leaky electric wave and a leaky transmission path of a receiving side, provided in parallel with the leaky transmission path of the sending side, for receiving the leaky electric wave emitted from the leaky transmission path of the sending side; and an intrusion detection device including a transmission circuit for outputting a predetermined electric signal to the leaky transmission path of the sending side, a receiving circuit for receiving the leaky electric wave received by the leaky transmission path of the receiving side, and an intrusion detection unit for detecting an intrusion between the separated leaky transmission paths and its location from a variation of the leaky electric wave received by the receiving circuit, wherein the intrusion detection device includes an anti-disturbing wave function unit for processing the signal received by the receiving circuit for removing or reducing a disturbing wave received by the leaky transmission path of the receiving side and for outputting the processed signal to the intrusion detection unit, and wherein the anti-disturbing wave function unit includes at least one anti-disturbing wave filter for processing the received analog signal and a finite impulse response digital filter as the anti-disturbing wave filter for processing the digital signal.

* * * * *